United States Patent [19]

Fujikawa et al.

[11] Patent Number: 4,748,945

[45] Date of Patent: Jun. 7, 1988

[54] VALVE GEAR FOR USE IN A FOUR-CYCLE ENGINE

[75] Inventors: Tetsuzo Fujikawa, Kobe; Makizo Hirata; Shinichi Tamba, both of Kakogawa, all of Japan

[73] Assignee: Kawasaki Jukogyo Kabushiki Kaisha, Kobe, Japan

[21] Appl. No.: 48,874

[22] Filed: May 12, 1987

Related U.S. Application Data

[60] Division of Ser. No. 862,170, May 9, 1986, Pat. No. 4,682,573, which is a continuation of Ser. No. 578,631, Feb. 9, 1984, abandoned.

[30] Foreign Application Priority Data

Feb. 15, 1983 [JP] Japan ..... 58-24442

[51] Int. Cl.[4] ..... F01L 1/34

[52] U.S. Cl. ..... 123/90.2; 123/90.15

[58] Field of Search ..... 123/90.2, 90.6, 90.21, 123/90.23, 90.15

[56] References Cited

U.S. PATENT DOCUMENTS

| | | | |
|---|---|---|---|
| 701,891 | 6/1902 | Kelsey | 123/90.2 |
| 893,675 | 7/1908 | Thier | 123/90.2 |
| 1,102,717 | 7/1914 | Brown | 123/90.2 |
| 1,248,597 | 12/1917 | Baker | 123/90.2 |
| 1,323,803 | 12/1919 | Zanaletti | 123/90.2 |
| 2,485,951 | 10/1949 | Zimmerman | 123/90.2 |
| 4,697,555 | 10/1987 | Fujikawa et al. | 123/90.23 |

*Primary Examiner*—Willis R. Wolfe
*Assistant Examiner*—David A. Okonsky
*Attorney, Agent, or Firm*—Leydig, Voit & Mayer

[57] ABSTRACT

Disclosed is a valve gear for use in a four-cycle engine which eliminates the necessity of providing a cam shaft. In the valve gear, a guide or guides, each of which is shaped like a closed curve making two rounds of a crank shaft with one intersection on the way, are provided. An air-intake valve and/or exhaust valve are controlled in accordance with the movement of a slider member sliding along the guide or guides.

19 Claims, 6 Drawing Sheets

VALVE GEAR FOR USE IN A FOUR-CYCLE ENGINE

This application is a division of application Ser. No. 862,170 filed May 9, 1986, and now U.S. Pat. No. 4,682,573, which is a continuation of application Ser. No. 578,631 filed Feb. 9, 1984 and now abandoned.

BACKGROUND OF THE INVENTION

The present invention relates to a four-cycle engine which has an air-intake valve and exhaust valve.

In a conventional four-cycle engine, a cam shaft is provided separately from a crank shaft. The speed of rotation of this cam shaft is reduced to ½ of that of the crank shaft by means of a reduction gear comprised of, for example, gears, sprockets or the like, thereby causing a lifting of the air-intake valve and exhaust valve through the use of a cam provided on the cam shaft. This lifting system of prior art, which uses such a cam shaft, has the following drawbacks. (1) It is necessary to equip the valve gear with the above-mentioned cam shaft, which results in an increase in the manufacturing cost involved. (2) A large amount of time is required for machining the gears and sprockets used for speed reduction. (3) Mechanical noises are great in intensity. (4) A chamber for reception of the crank need be large with the result that it is difficult to miniaturize the section associated with the valve gear. (5) Since the air-intake valve and exhaust valve are disposed closely to each other, there is a likelihood that gas exchange becomes incomplete. And, (6) Since the air-intake valve and exhaust valve are close to each other, the cylinder undergoes a high thermal distortion.

SUMMARY OF THE INVENTION

The object of the present invention is to provide a valve gear which can eliminate the above-mentioned conventional drawbacks and which is simple in structure and low in noises and in which the valve disposition advantageous for the action or function, as well as for the mechanical strength, of the valves is possible.

The above object can be achieved by a valve gear comprising a guide means provided on the outer surface of a crank shaft and shaped like a closed curve making two rounds of a crank shaft with one intersection on the way, whereby at least one of the air-intake valve and exhaust valve is controlled by the movement of a slider member sliding in the guide means.

Other and further objects, features and advantages of the invention will appear more fully from the following description.

DETAILED DESCRIPTION OF THE PREFERRED EMBODIMENTS

Figure 1:
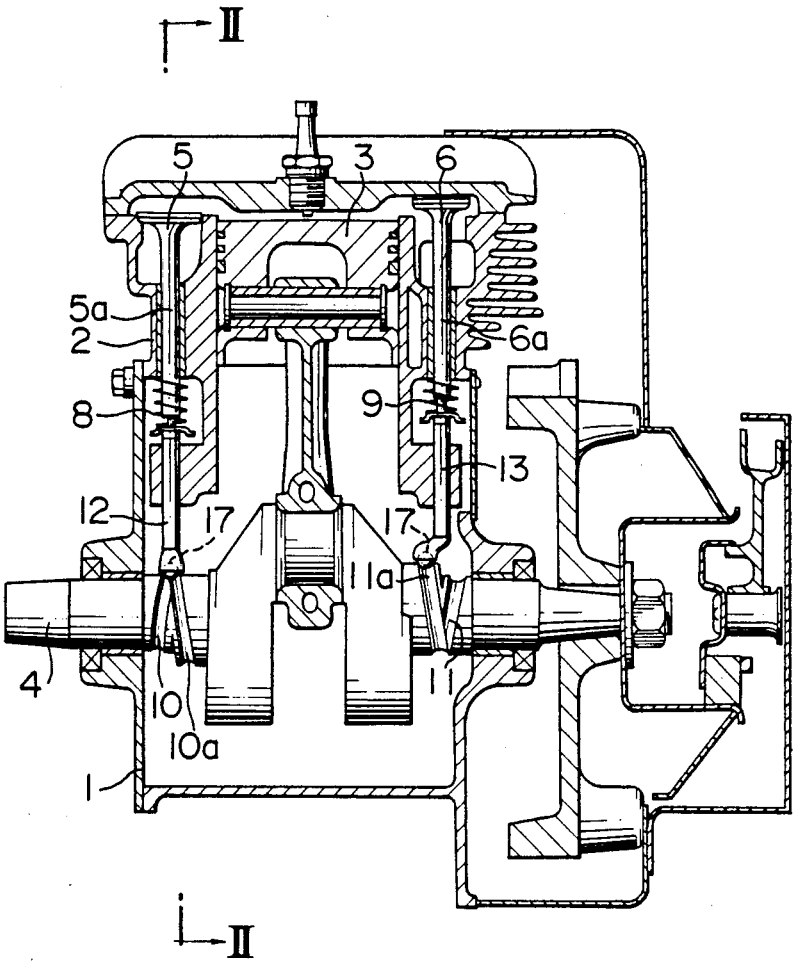
FIG. 1 is a side view, in vertical section, of a four-cycle engine to which the present invention is applied.

Referring now to FIG. 1, a cylinder block 2 is made integral with a crank case and is mounted with a crank case cover 1. A piston 3 is disposed within the cylinder block 2. Further, a crank shaft 4 is extended through the crank case. At the left and right side portions of the illustrated cylinder block 2, an air-intake valve 5 and an exhaust valve 6 are disposed, respectively, which air-intake valve 5 and exhaust valve 6 are equipped with valve stems 5*a* and 6*a*, respectively, and are supported by the cylinder block 2 in such a manner as to be made rockable about, and vertically slidable along, their axes, respectively, and are normally urged in the valve closing direction, i.e., in the downward direction, by means of valve springs 8 and 9, respectively.

Guide grooves 10 and 11 respectively used for the air-intake valve and exhaust valve are formed on those left and right side portions of the illustrated crank shaft 4 which are located within the crank case cover 1. Said guide grooves 10 and 11 are connected to valves 5 and 6, respectively, through slider members 12 and 13.

The guide groove 10 used for the air-intake valve is shaped like a closed curve (See FIG. 4) making two rounds of the crank shaft 4 with one intersection on the way. The bottom surface of the guide groove 10 is formed into a cam surface and is provided with a raise 10*a* (See FIG. 1) protruded outwards in the radial direction of the crank shaft 4.

Figure 2:
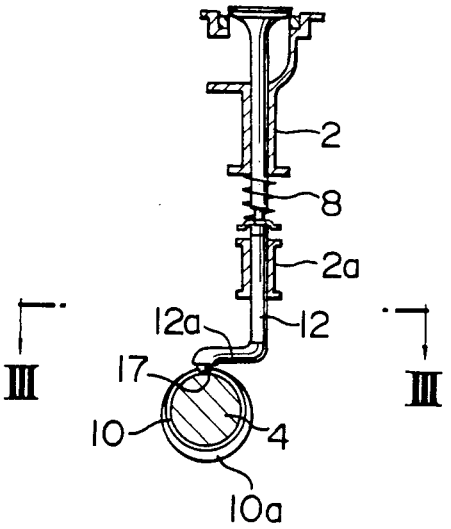
FIG. 2 is a sectional view taken along the line II—II of FIG. 1.
Figure 3:
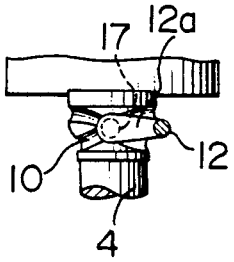
FIG. 3 is a sectional view taken along the line III—III of FIG. 2.

The slider member 12 for use in the air-intake valve is formed into a vertically elongated rod, and is rotatably and vertically movably supported by a supporting wall portion 2*a* of the cylinder block 2, as shown in FIG. 2. The slider member 12 is formed, at its lower end, with a horizontal arm portion 12*a* extending up to a position substantially right on an upper end edge portion of the crank shaft 4, which horizonal arm portion 12*a* is made rockable about a vertical axis of the slider member 12 integrally with this member 12. At a tip end portion of this arm portion 12*a*, a ball 17 is rotatably supported thereon, which ball 17 is engaged with the guide groove 10.

The slider member 13 for use in the exhaust valve and the guide groove 11 are respectively of similar structures to those of the slider member 12 for use in the air-intake valve and the guide groove 10. The raises 10*a*, 11*a* of the guide grooves 10 and 11 are formed at the angular positions of crank which correspond to the time periods in which the air-intake valve 5 and exhaust valve 6 are opened, respectively.

In operation, when the crank shaft 4 is allowed to rotate, for example the ball 17 for use in the air-intake valve is guided by the guide groove 10. During a time period in which the crank 4 makes its two rotations about its axis, said ball 17 is kept in sliding contact with the surface of the guide groove 10 throughout the entire length thereof. During this period, one lifting operation is imparted to the air-intake valve 5 by means of the raise 10a. Further, during the two-rotation period of the crank shaft 4, the arm portion **12*a* makes one reciprocating rocking movement, i.e., leftwards from the illustrated position of FIG. 1 and rightwards from the left position, thereby imparting a rocking operation to the air-intake valve 5**.

As in the case of the air-intake valve, one lifting operation is imparted to the exhaust valve 6 by means of the raise **11*a* during the two-rotation period of the crank shaft 4** correspondingly to exhaust timing.

Figure 5:
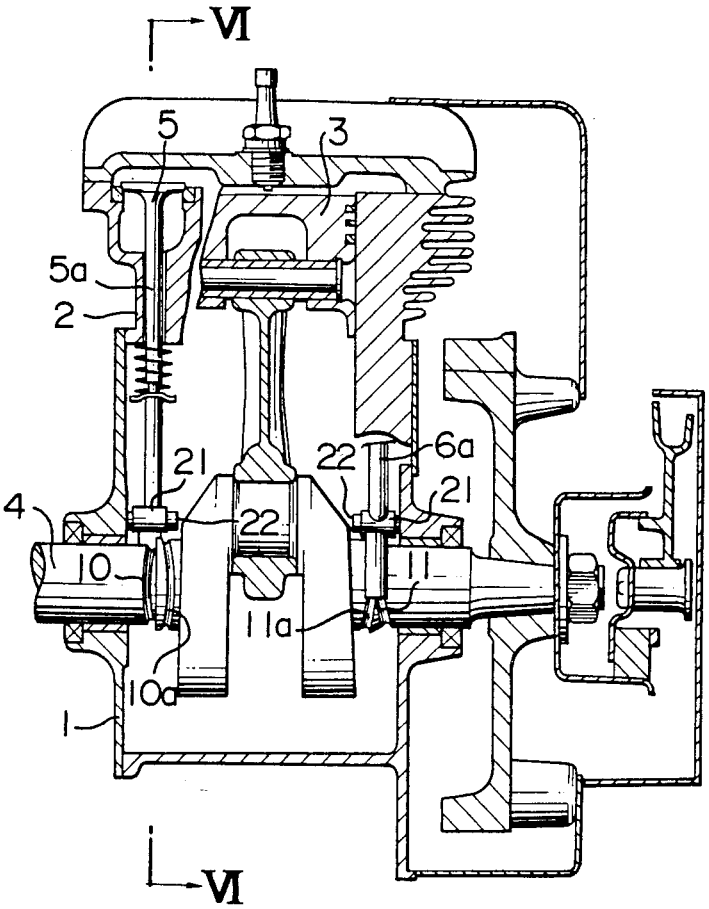
FIG. 5 is a side view, in vertical section, of the four-cycle engine according to another embodiment of the invention.
Figure 6:
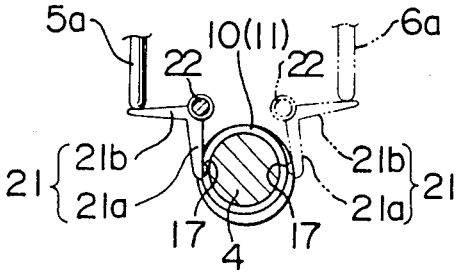
FIG. 6 is a sectional view taken along the line VI—VI of FIG. 5.

FIGS. 5 and 6 show the valve gear according to another embodiment of the invention. In this embodiment, the slider members comprise bell cranks 21. Each bell crank 21 is pivotally mounted onto a support shaft 22 parallel with the crank shaft 4 so that it may be movable in the axial direction of, and rockable or rotatable about, the support shaft 22. A downwardly extending arm portion **21*a* (See FIG. 6) of the bell crank 21 has its lower end portion engaged with the guide groove 10 or 11 through the rotating ball 17. The respective tip end portions of horizontally extending arm portions 21*b* of the bell cranks 21 are allowed to abut, from below, against the lower end edges of the valve stems 5*a* and 6*a***, respectively.

Figure 4:
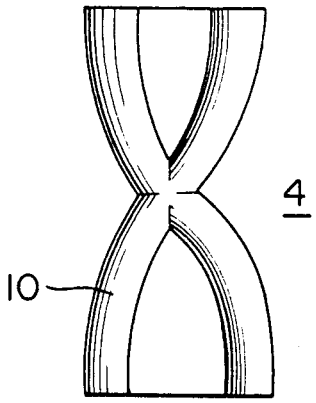
FIG. 4 is a development view of a guide portion.

As in FIG. 4, each guide groove 10 or 11 takes the form of a closed curve making two rounds of the crank shaft 4 with one intersection on the way and returning to its original position. The guide grooves 10 and 11 have their bottom surfaces shaped as cam surfaces, respectively, which bottom surfaces are formed with raises **10*a* and 11*a*** at their angular positions of crank which correspond to the time of suction and exhaust, respectively.

It should be noted here that, in FIG. 5, those parts and sections which correspond to the parts and sections of FIG. 1 are denoted by like reference numerals, respectively.

In the valve gear of FIG. 5, during the period of two rotations of the crank shaft 4, each bell crank 21 is rocked about the support shaft 22 by the cam action of the raise **10*a* or 11*a* at the time of air suction or exhaust, thereby causing a lifting of the air-intake valve 5 or exhaust valve 6**.

Figure 7:
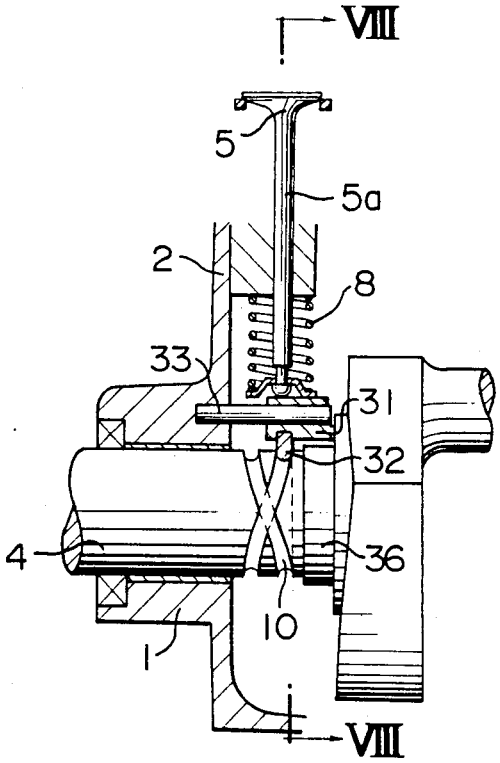
FIG. 7 is a side view, in vertical section, of the four-cycle engine acording to still another embodiment of the invention.
Figure 8:
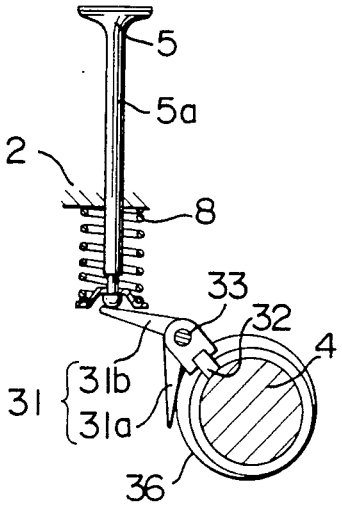
FIG. 8 is a sectional view taken along the line VIII—VIII of FIG. 7.

FIGS. 7 and 8 show the valve gear according to still another embodiment of the invention, in which the valve stem **5*a* is coupled with the guide groove 10 by means of a bell crank 31 and a sliding contact or slider member 32. The bell crank 31 is pivotally mounted a support shaft 33 parallel with the crank shaft 4 so that it may be movable in the axial direction of, and rockable about, said support shaft 33. The slider member 32 is secured to the bell crank 31. At the same time the slider member 32 is engaged with the guide groove 10, the latter guiding the motion of the bell crank 31 in the axial direction of the crank shaft 4**.

The guide groove 10, as illustrated, is disposed over an axial length of the crank shaft and is formed into a closed curve making two rounds of the crank shaft 4 and returning to its original position. The crank shaft 4 is formed with a cam surface 36 separately from the guide groove 10, at the position adjacent to the same.

A horizontally extending arm portion **31*b* (See FIG. 8) of the bell crank 31 is so formed that its width taken in the axial direction of the support shaft 33 may be enlarged. As a consequence, the arm portion 31*b* can abut against the lower end edge of the valve stem 5*a* at all times independently of the axial movement of the bell crank 31. A downwardly extending arm portion 31*a* of the bell crank 31 is so formed that its axial width may be narrower or smaller than that of the horizontal arm portion 31*b*. The arm portion 31*a* abuts against the cam surface 36 during only a period in which the bell crank 31 is moved to the side of the cam surface 36 as shown in FIG. 7. That is to say, during the period of two rotations of the crank shaft 4, the downwardly extending arm portion 31*a* abuts against the cam surface 36 for only a period corresponding to substantially one rotation of the crank shaft 4**.

Although not shown, the exhaust valve is arranged such that it undergoes a lifting operation by means of the bell crank 31 and slider member 32 similar to those of the air-intake valve.

In the valve gear of FIGS. 7 and 8, the valve 5 is once pushed up during the two-rotation period of the crank shaft 4 through the axial reciprocating movement of the slider member 32 and bell crank 31 made by the engagement between the slider member 32 and the guide groove 10 as well as through the rocking movement of the bell crank 31 about the support shaft 33 made by abutment between the downwardly extending arm portion **31*a* and the cam surface 36. That is to say, during the period of two rotations of the crank shaft 4, the arm portion 31*a* is kept in engagement with the cam surface 36 to once push up the valve 5 by the cam action caused thereby, for only a length of time corresponding to the period of substantially one rotation of the crank shaft 4 in which the slider member 32 abuts against a right half portion of the guide groove 10 illustrated in FIG. 7**.

As in the case of the air-intake valve 5, the exhaust valve is also pushed up once for the period of two rotations of the crank shaft 4.

Figure 9:
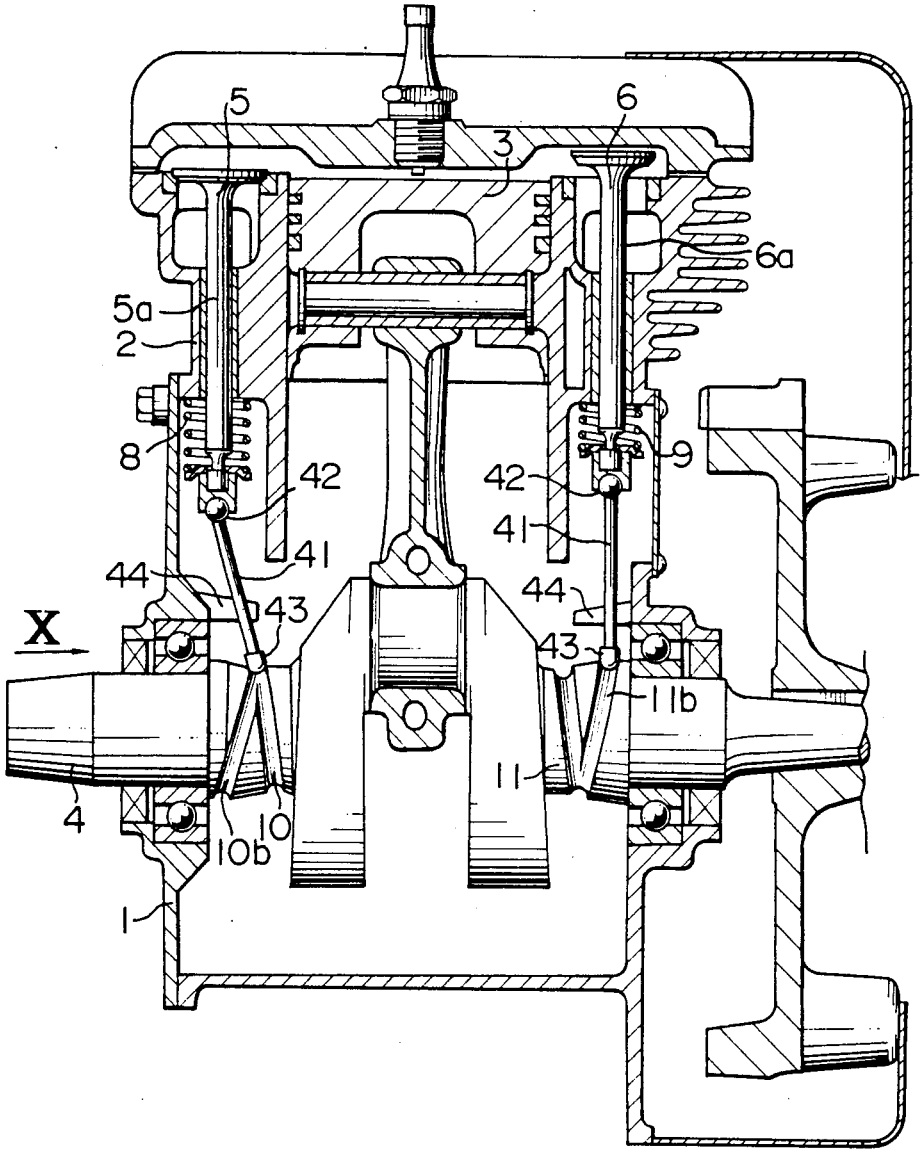
FIG. 9 is a side view, in vertical section, of the four-cycle engine according to a further embodiment of the invention.
Figure 10:
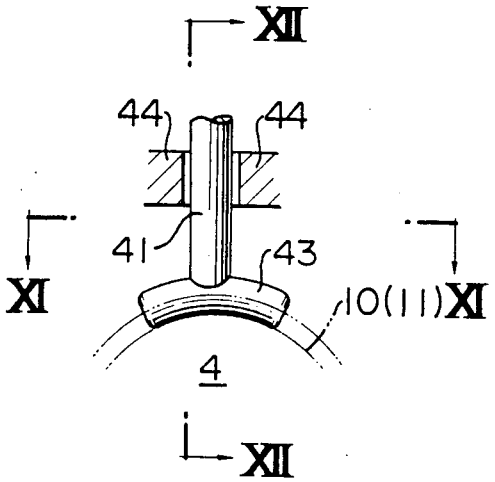
FIG. 10 is an enlarged partial view as viewed from an arrow X of FIG. 9.
Figure 11:
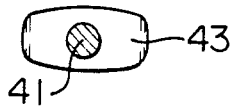
FIG. 11 is a sectional view taken along the line XI—XI of FIG. 10.
Figure 12:
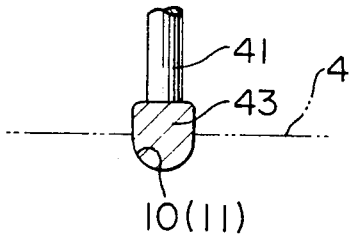
FIG. 12 is a sectional view taken along the line XII—XII of FIG. 10.

FIGS. 9 to 12 show the valve gear according to a further embodiment, or fourth embodiment, of the present invention, in which each slider member comprises a push rod 41. Each push rod 41 has its upper end pivotally connected to the lower end of the valve 5 or 6 through a ball joint 42. The lower end portion of the push rod 41 is made rockable in the longitudinal direction of the crank shaft 4. As shown in FIG. 10, the push rod 41 is formed, at its lower end, with a sliding contact portion 43 shaped like a circular arc as viewed in the direction indicated by arrow mark X of FIG. 9, which sliding contact portion 43 is engaged with the corresponding guide groove 10 or 11. The lower side portion of the sliding contact portion 43 is shaped, in cross section, like a circular arc in match with the shape, in cross section, of the guide groove 10 (11) as shown in FIG. 12.

As in FIG. 4, each guide groove 10 or 11 is shaped like a closed curve making two rounds of the outer surface of the crank shaft 4 and returning to its original position with one intersection on the way. The guide groove 10 for use in the air-intake valve is slightly protruded, at its left side portion **10*b* of FIG. 9, in the outward direction of the crank shaft 4 taken radially thereof. On the other hand, the guide groove 11 for use in the exhaust valve is also slightly protruded, at its right side portion 11*b* of FIG. 9, in the outward direction of the crank shaft 4** taken radially of the same.

The push rod 41 has its intermediate portion inserted in a slot defined between a pair of guide members 44 as shown in FIG. 10, whereby the push rod 41 is prevented, by the guide members 44, from being rocked in a direction perpendicular to the axis of the crank shaft 4.

In the valve gear shown in FIGS. 9 to 12, a lifting operation is imparted to each valve 5 or 6 by the rocking movement of the push rod 41 in the axial direction of the crank shaft 4. That is to say, each push rod 41 makes one reciprocating rocking movement in the axial direction of the crank shaft 4 during the period of two rotations thereof. Thus, when the lower end sliding contact portion 43 of the push rod 41 is kept in sliding contact with the left side portion 10*b* of the guide groove 10, the push rod 41 at the side of the air-intake valve pushes up the air-intake valve 5. On the other hand, the exhaust valve 6 is pushed up when the lower end sliding contact portion 43 of the push rod 41 is kept in sliding contact with the right side portion 11*b* of the guide groove 11 as in FIG. 9.

In FIG. 9, the same parts and sections as those of FIG. 1 are denoted by like reference numerals.

It should be noted here that guide rails having convexed surfaces may be provided, in place of the guide grooves, as the guide portions or means.

As described above, according to the present invention, (1) since it is possible to eliminate the necessity of using a cam shaft, a large reduction in the manufacturing cost involved can be achieved and further the engine can be made more compact. (2) Since machining or fabricating the gears and sprockets used for reduction in speed of the cam shaft becomes unnecessary, a smaller amount of time is only required for manufacturing the valve gear. (3) It is possible to decrease the mechanical noises in magnitude. (4) It is possible readily to adopt what is called "cross-flow" type valve disposition structure wherein the air-intake valve and exhaust valve are disposed with a combustion chamber interposed therebetween, because both the valves need not be disposed close to each other. Accordingly, the efficiency with which the gas is filled increases, and, at the same time, the cylinder undergoes less thermal distortion. (5) Since the slider members 12 and 13 of FIG. 1 can impart suitable rotary rocking movements to the valves 5 and 6, respectively, it is possible to abolish the use of valve rotators. (6) Since, in the second and third embodiments of the invention, a bell crank is utilized slider member, it becomes unnecessary to dispose the air suction valve and exhaust valve right above the crank shaft, with the result that the latitude of taking the positions of both valves is enlarged. Thus, the manufacturing and assembling operations become easy.

In the described embodiments, both the air-intake valve and exhaust valve are so arranged as to operate through the use of the guide portions and slider member as shown in the Figures. According to the invention, however, arrangement can be made such that either the air-intake valve or the exhaust valve only operates through the use of the guide section and its slider member. Further, where a bell crank is used, it is possible to arrange a single guide section to guide two bell cranks for the air-intake valve and the exhaust valve.

Having described a specific embodiments of our bearing, it is believed obvious that modification and variation of our invention is possible in light of the above teachings.

What is claimed is:

1. A valve assembly of a four-cycle engine comprising a valve having a valve stem, a crank shaft, guide means shaped like a closed curve making two rounds provided in the outer surface of said crank shaft with one intersection on the way, a slider member sliding along said guide means and connected to control said valve, a shaft parallel with said crank shaft, and means for mounting said slider member on said shaft so as to pivot about and slide along said shaft.

2. A valve assembly of a four-cycle engine comprising a valve having a valve stem, a crank shaft having a longitudinal axis, guide means shaped like a closed curve making two rounds provided in the outer surface of said crank shaft with one intersection on the way, a slider member sliding along said guide means and connected to control said valve, and means for pivotally mounting said slider member to said valve stem so that said slider member is rockable within a plane including said slider member and the longitudinal axis of said crank shaft.

3. A valve assembly of an internal combustion engine having a crank case and a cylinder block, said valve assembly comprising:

a valve having a valve stem with a longitudinal axis, said valve being slidably supported along the longitudinal axis by the cylinder block;

a crank shaft having a longitudinal axis and being rotatably supported in the crank case;

a guide groove having a closed curve configuration making two rounds of said crank shaft with one intersection between rounds;

a cam disposed on said crank shaft adjacent said guide groove and comprising a cam surface having a raised portion protruding outwardly in the radial direction of said crank shaft;

a support shaft supported by the cylinder block and extending generally parallel to the longitudinal axis of said crank shaft; and a bell crank pivotally supported on, and axially slidable on, said support shaft and having first and second arms, said first arm slidably engaging said guide groove and operatively engageable with said cam surface and said second arm abutting said valve stem to reciprocate said valve stem in response to rotation of said crank shaft.

4. A valve assembly of an internal combustion engine having a crank case and a cylinder block, said valve assembly comprising:

a valve having a valve stem with a longitudinal axis, said valve being slidably supported along the longitudinal axis by the cylinder block;

a crank shaft having a longitudinal axis and being rotatably supported in the crank case;

a guide groove disposed on said crank shaft and having a closed curve configuration making two rounds of said crank shaft with one intersection between rounds, said guide groove including a cam surface having a raised portion protruding outwardly in the radial direction of said crank shaft; and a slider member interconnecting said guide groove and said valve stem and comprising a push rod, a sliding contact portion connected to said push rod and slidably engaging said guide groove, and a pivotal joint pivotally coupling said push rod to said valve stem, said slider member having a portion movable longitudinally with respect to the crankshaft axis within a plane including said slider member and the longitudinal axis of the crankshaft.

5. A valve assembly according to claim 4 further comprising restraining means cooperating with said slider member for restraining lateral movement of said push rod and allowing said push rod to move parallel to the longitudinal axis of said crank shaft.

6. A valve assembly of an internal combustion engine having a crank case and a cylinder block, said valve assembly comprising:

a valve having a valve stem with a longitudinal axis, said valve being slidably supported along the longitudinal axis by the cylinder block;

a crank shaft having a longitudinal axis and being rotatably supported in the crank case;

guide means disposed on said crank shaft and comprising a cam surface and a guide groove, said cam surface having a raised portion protruding outwardly in the radial direction of said crank shaft and said guide groove having a closed curve configuration making two rounds of said crankshaft with one intersection between rounds;

a slider member engaged with said valve stem, slidably engaged with said guide groove, and operatively engageable with said cam surface; and means for pivotally mounting said slider member while always maintaining said slider member in engagement with both said guide groove and said valve stem and allowing said slider member to move within a plane including said slider member and the longitudinal axis of said crank shaft.

7. A valve assembly according to claim 6 wherein said guide groove is formed in the outer suface of said crank shaft.

8. A valve assembly according to claim 6 wherein said mounting means comprises a support shaft supported by the cylinder block and extending generally parallel to the longitudinal axis of said crank shaft and wherein said slider member comprises a bell crank, said bell crank being pivotally supported on, and axially slidable on, said support shaft and having first and second arms, said first arm being slidably engageable with said cam surface and said second arm abutting said valve stem.

9. A valve assembly according to claim 8 wherein said valve is disposed laterally relative to the longitudinal axis of said crank shaft and said bell crank extends laterally between said guide means and said valve.

10. A valve assembly according to claim 8 wherein said guide groove includes said cam surface and said first arm is slidably engaged in said guide groove with said cam surface.

11. A valve assembly according to claim 10 wherein said raised portion is formed in one of the rounds of said guide groove whereby said first arm engages said raised portion once in every two revolutions of said crank shaft.

12. A valve assembly according to claim 10 wherein said bell crank comprises a ball rotatably coupled to said first arm.

13. A valve assembly according to claim 8 wherein said guide means further comprises a cam disposed on said crank shaft adjacent said guide groove and having an exterior surface, said cam surface comprising the exterior surface of said cam, and wherein said bell crank further includes a sliding contact slidably engaged in said guide groove.

14. A valve assembly according to claim 13 wherein said first and second arms each has a width in the axial direction of said crank shaft, the width of said first arm being less than the width of said second arm, and wherein said guide groove is disposed over an axial length of said crank shaft whereby said guide groove guides the motion of said bell crank parallel to the longitudinal axis of said crank shaft and said first arm operatively engages said raised portion once in every two revolutions of said crank shaft.

15. A valve assembly according to claim 6 wherein said slider member comprises a push rod pivotally mounted to said valve stem by said mounting means, said push rod pivoting in the longitudinal direction of said crank shaft.

16. A valve assembly according to claim 15 wherein said mounting means comprises a ball joint.

17. A valve assembly according to claim 16 wherein said mounting means includes a pair of guide members defining a slot therebetween and parallel to the longitudinal axis of said crank shaft, said push rod pivoting in the slot between said guide members.

18. A valve assembly according to claim 15 wherein said slider member comprises a semicircular longitudinal cross section and is located to extend lengthwise in a circular guide groove.

19. A valve assembly according to claim 15 wherein said slider member comprises a contact surface contacting said cam surface, said contact surface having a shape substantially similar to that of said guide groove in cross section.

* * * * *